US006916256B1

(12) United States Patent
Buster et al.

(10) Patent No.: US 6,916,256 B1
(45) Date of Patent: Jul. 12, 2005

(54) BATTER SWING TRAINING APPARATUS

(75) Inventors: Benjamin D. Buster, 501 Cahaba Dr., Selma, AL (US) 36701; Bruce F. Coody, Hoover, AL (US)

(73) Assignee: Benjamin D. Buster, Selma, AL (US)

( * ) Notice: Subject to any disclaimer, the term of this patent is extended or adjusted under 35 U.S.C. 154(b) by 0 days.

(21) Appl. No.: 10/679,967

(22) Filed: Oct. 6, 2003

Related U.S. Application Data

(63) Continuation-in-part of application No. 10/036,276, filed on Oct. 24, 2001, now abandoned.

(60) Provisional application No. 60/248,800, filed on Nov. 15, 2000, provisional application No. 60/243,422, filed on Oct. 25, 2000.

(51) Int. Cl.[7] ..... A63B 69/00
(52) U.S. Cl. ..... 473/451; 473/422; 473/452
(58) Field of Search ..... 473/422, 451–453, 473/457, 450, 458, 464; 124/1, 7, 8, 21, 36

(56) References Cited

U.S. PATENT DOCUMENTS

| | | | | |
|---|---|---|---|---|
| 1,126,208 | A | | 1/1915 | Hayford |
| 1,488,900 | A | | 4/1924 | Armstrong |
| 2,706,003 | A | | 3/1955 | Schensted |
| 3,627,319 | A | | 12/1971 | VanSkyhawk |
| 3,809,397 | A | | 5/1974 | Gruenewald |
| 3,815,906 | A | * | 6/1974 | Hermo ..... 473/452 |
| 3,833,217 | A | | 9/1974 | Greaney |
| 4,778,177 | A | | 10/1988 | Taksony |
| 5,002,275 | A | | 3/1991 | Beutler et al. |
| 5,066,010 | A | * | 11/1991 | Pingston ..... 473/451 |
| 5,165,683 | A | | 11/1992 | Beutler et al. |
| 5,263,863 | A | | 11/1993 | Stefani et al. |
| 5,395,107 | A | | 3/1995 | De Pippo |
| 5,590,876 | A | | 1/1997 | Sejnowski |
| 5,762,565 | A | | 6/1998 | Milam et al. |
| 5,839,983 | A | | 11/1998 | Kramer |
| 5,916,037 | A | | 6/1999 | Hill |
| 6,120,386 | A | | 9/2000 | Hill |
| 6,390,939 | B1 | * | 5/2002 | Palacios ..... 473/422 |
| 6,579,195 | B2 | * | 6/2003 | Lamb ..... 473/417 |

* cited by examiner

*Primary Examiner*—Mitra Aryanpour
(74) *Attorney, Agent, or Firm*—Jones, Walker, Waechter, Poitevent, Carrere & Denegre, L.L.P.

(57) ABSTRACT

A baseball swing training apparatus includes a ground frame section with a forward motion restraint attached to the ground frame section. The forward motion restraint will be adjustable such that the forward motion restraint is positionable at various levels on the body of a user. The training apparatus will further include a ball launcher, a foot plate and a trigger attached to the foot plate for activating the ball launcher.

16 Claims, 7 Drawing Sheets

70

BATTER SWING TRAINING APPARATUS

This application is a continuation-in-part of U.S. patent application Ser. No. 10/036,276 filed Oct. 24, 2001, now abandoned, which claims the benefit of U.S. Provisional Application Ser. No. 60/243,422 filed Oct. 25, 2000 and U.S. Provisional Application Ser. No. 60/248,800 filed Nov. 15, 2000, all of which are incorporate herein by reference.

1. FIELD OF INVENTION

The present invention relates to sports training devices and more particularly, to a device for training baseball players to maintain the most advantageous stance, body position, and weight distribution while batting.

Proper body position, balance, and weight distribution prior to beginning (and during) a swing of the baseball bat is a key element to a baseball player or batter developing the most effective and powerful swing possible. While waiting for a pitch, the batter should maintain a 55/45 weight distribution with the rear foot carrying the higher weight. As the batter strides to hit the ball, this ratio should not change, and thus the swing should be executed with little or no weight transfer onto the front leg. This will assist the batter in using to the muscles of the hips and legs to turn the torso during the swing and not to "step into" the oncoming ball which takes the head and shoulders forward and reduces the ability to make contact with the ball and reduces the power of the swing. However, the prior art has not provided a swing training system which reinforces the need to turn into the ball and not step into the ball. All of the prior art allows the batter to incorrectly move forward as the swing is executed, thereby reducing the force that can be applied to the baseball. Most swing training devices do little more than launch a ball into the strike zone in order for the batter to swing at the ball. Pitching machines which launch balls at realistic pitching speeds are well known in the art. However, these machines do nothing to improve a batter's stance. Similarly, "soft toss" devices which are positioned on the ground within the strike zone and launch the ball vertically to allow the batter to swing at the ball, also provide no assistance with the batter's stance.

What is needed in the art is a swing training system which encourages the batter to maintain weight more centered rather than stepping into the ball. The training system should be inexpensive to manufacture, be easily portable, and be readily adjustable for players of all different ages and heights.

2. SUMMARY OF INVENTION

The present invention provides a batter training apparatus. The training apparatus includes a ground frame section with a forward motion restraint attached to the ground frame section. The forward motion restraint will be adjustable such that the forward motion restraint is positionable at various levels against the body of a user. The training apparatus will further include a ball launcher and a trigger for activating the ball launcher.

The present invention also includes a training apparatus having a support tube with a diameter approximate to that of a bat at the bat's striking surface and three substantially flat striking surfaces connected to and surrounding the support tube, thereby forming a triangular structure around the support tube.

3. BRIEF DESCRIPTION OF THE DRAWINGS

4. DETAILED DESCRIPTION OF THE INVENTION

Figure 1:
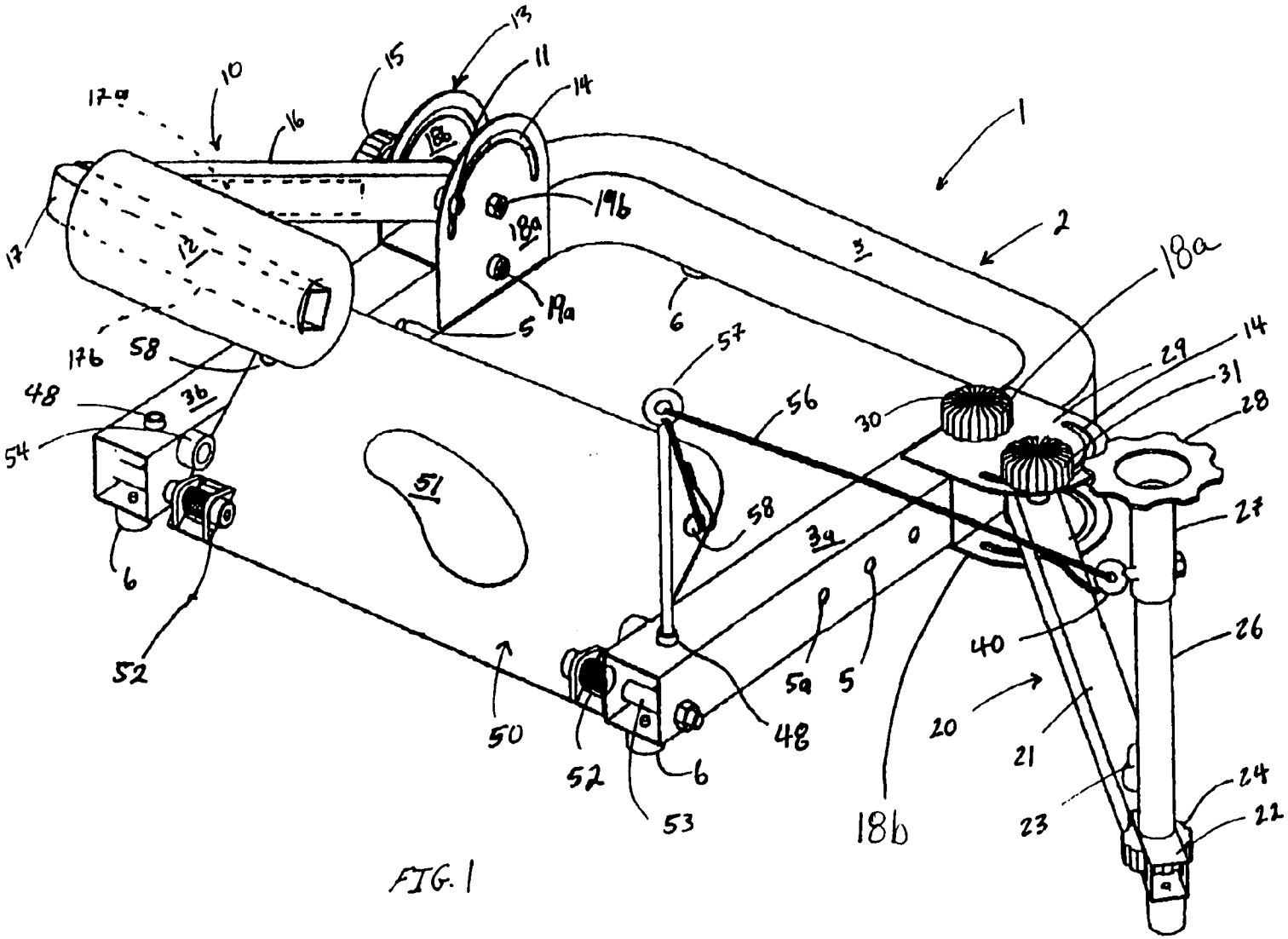
FIG. 1 is a prospective view of the batter training apparatus of the present invention.

FIG. 1 illustrates the batter training apparatus 1 of the present invention. The embodiment seen in FIG. 1 shows how the training apparatus 1 will generally comprise a ground frame section 2, a forward motion restraint device 10, a ball launcher 20 and a foot plate 50. The embodiment of ground frame section 2 seen in FIG. 1 will be constructed of a generally U-shaped tubular frame member 3. Tubular frame member 3 generally has a square shaped cross-section and may be constructed of a metal such as steel or high strength aluminum. However, frame member 3 need not have a square cross-section, nor necessarily be tubular. Additionally, frame member 3 could be constructed of materials other than metals such as high strength polymers. Frame member 3 may also include a series of apertures 5 (explained below) and feet 6.

Forward motion restraint 10 will be positioned on frame member 3 and will include bracket 13 with flanges 18*a* and 18*b* engaging two sides of frame member 3. A bolt 19*a* will extend through one of the apertures 5 and secure bracket 13 to frame member 3. While hidden from view, it will be understood that bolt 19*a* will have a knob (similar to the other knobs seen in FIG. 1) which allows for easy attachment and detachment of bracket 13. Bracket 13 will also include adjusting channels 14. An outer bar 16, generally formed of a square tubular member, will be pivotally connected to bracket 13 by way of bolt 19*b*. Another bolt, bolt 11 will extend from knob 15, through an aperture in outer bar 16, and engage channel 14. The end of bolt 11 engaging channel 14 will have a cap fixed thereon whose diameter is larger than the width of channel 14, thus preventing bolt 11 from being withdrawn from channel 14. The end of bolt 11 connected to knob 15 will be threaded. Bolt 11 will be fixed within outer bar 16 such that bolt 11 cannot rotate with respect to outer bar 16. It can be understood how tightening the knob 15 will press flanges 18*a* and 18*b* against outer bar 16 and fix it in place. Likewise, loosening knob will allow outer bar 16 to rotate freely in channel 14. In this manner, the angle of outer bar 16 in bracket 13 may be readily adjusted and then locked into place.

An inner bar 17 will be formed of a similar, but slightly smaller cross-section than outer bar 16, such that a subsection of inner bar 17 (subsection 17*a*) may slide within outer bar 16 in a telescoping manner. While hidden from view in FIG. 1, it will be understood that inner bar 17 and outer bar 16 will have corresponding side apertures. An adjusting pin (also hidden from view) will engage the apertures in both bars to adjustably fix the length of inner bar subsection 17*a* which extends from outer bar 16. It can also be seen in FIG. 1 that inner bar 17 is generally L-shaped having a second subsection 17*b*. Subsection 17*b* will form the frame for the part of forward motion restraint 10, which actually contacts the batter. To prevent the rigid metal subsection 17*b* from contacting the batter's body, subsection 17*b* will have a padding tube 12 fixed thereto.

Positioned opposite of forward motion restraint 10 will be ball launching assembly 20. Ball launching assembly 20 generally comprises adjustable bracket 29, outer bar 21, inner bar 22, main spring tube 26, and scallop piece 28 upon which a ball is intended to rest. Adjustable bracket 29, with flanges 18*a* and 18*b*, is substantially identical to bracket 13 discussed above. Knob 30 will be attached to a bolt (not shown) which will extend through a bolt aperture to secure bracket 29 to frame member 3. Outer bar 21 will be pivotally attached to bracket 29 and may be fixed at a given angle by way of tightening knob 31. Inner bar 22 (best seen in FIGS. 2A–2C) will have a plurality of apertures and be sized to slide within outer bar 21. Outer bar 21 will have an aperture through which spring pin 23 (see FIG. 1) may be inserted to fix the relative positions of inner bar 22 and outer bar 21. Spring pin 23 will be a conventional biased retaining pin fixed to outer bar 21. It will be possible to pull the retaining pin upward out of an aperture 9 (see FIG. 2A), to adjust inner bar 22 inward or outward, and then to release the retaining pin to re-engage another aperture 9. Therefore, inner bar 22 is readily adjustable in a radial direction relative to bracket 29.

Figure 2C:
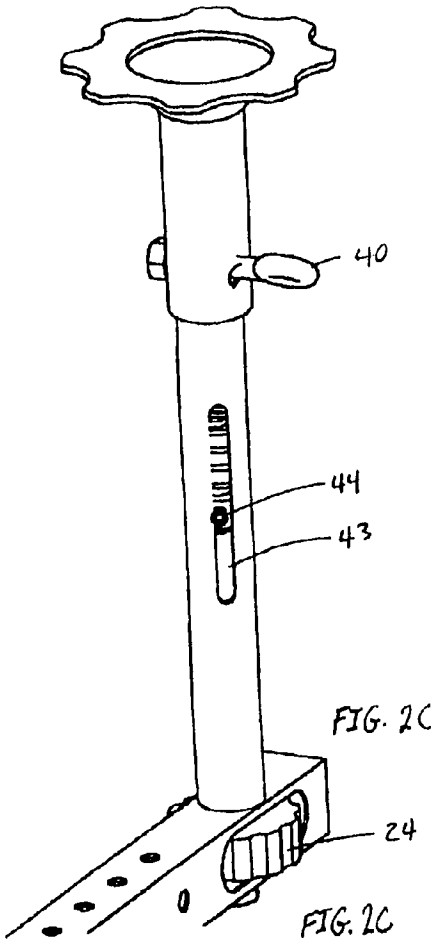
FIGS. 2A–2C are different views of the ball launcher utilized in the present invention.
Figure 2B:
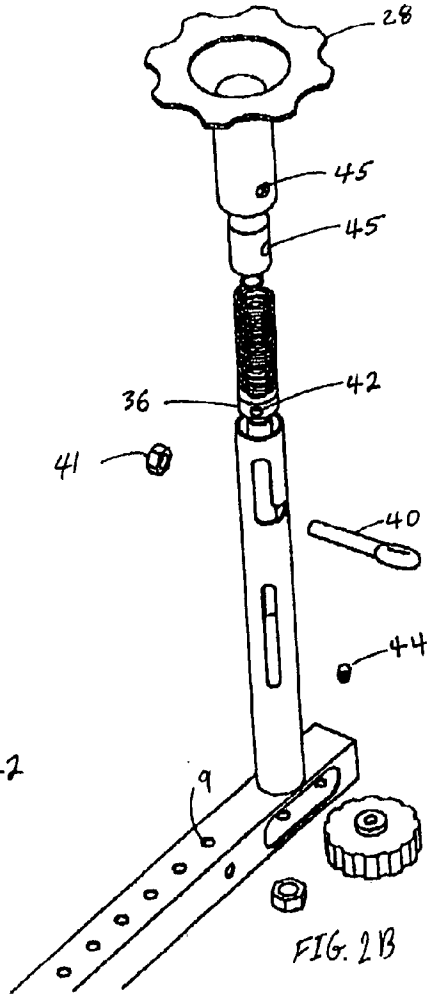
Figure 2A:
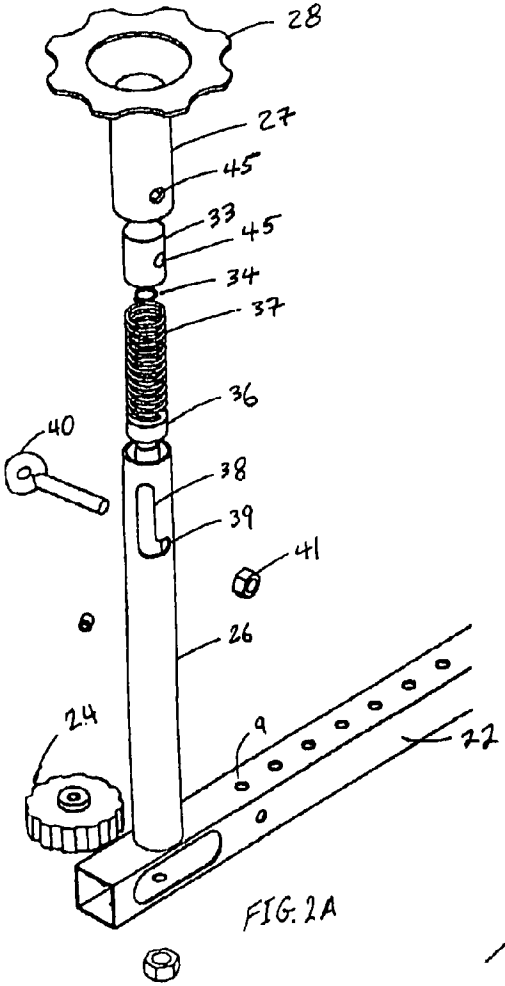
Figure 3B:
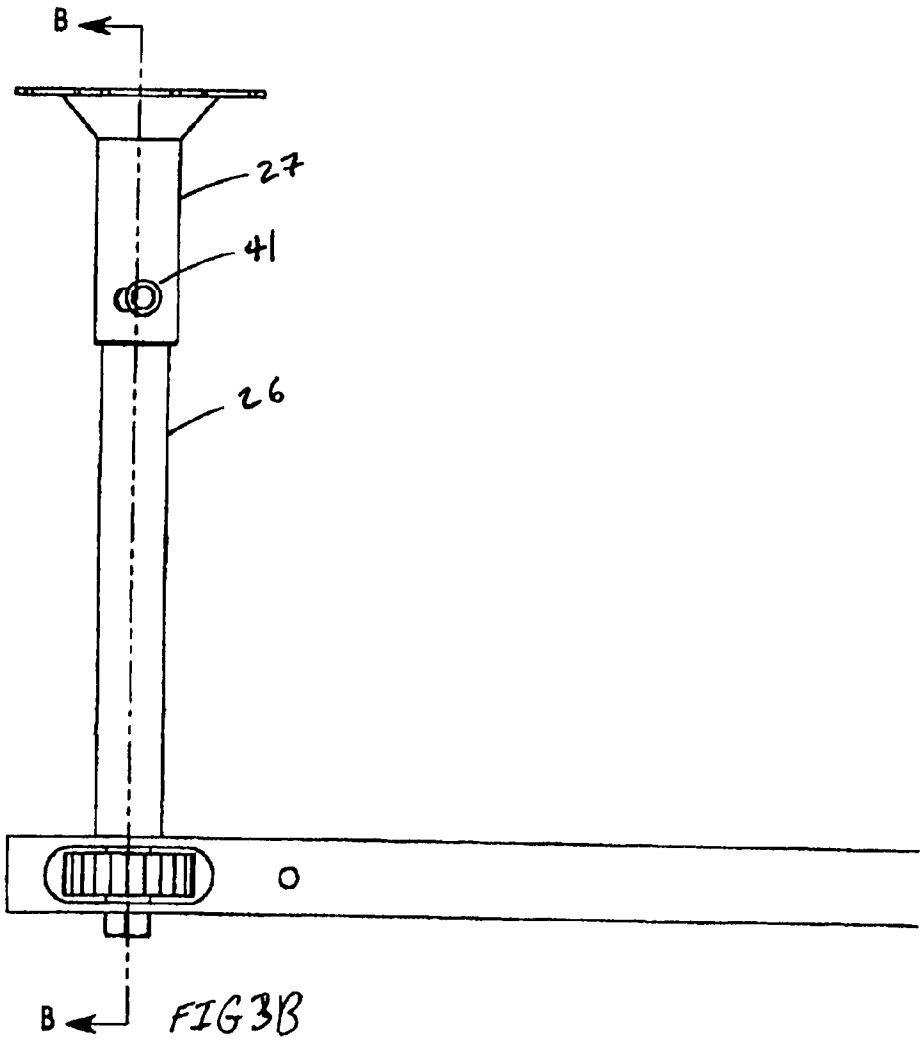
FIGS. 3A and 3B are side views of the ball launcher with FIG. 3A being a sectional view taken along the line BB seen in FIG. 3B.
Figure 3A:
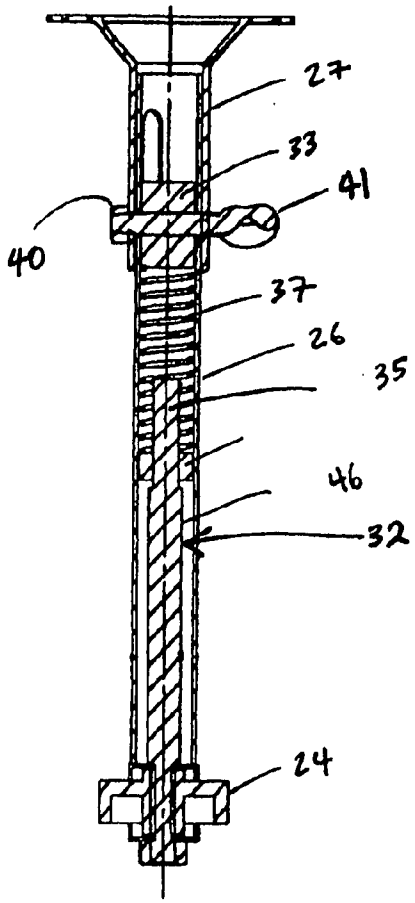

As shown in FIGS. 2A–2C, spring tube 26 will be attached to and extend upwards from inner bar 22. As suggested in the figures, spring tube 26 will be hollow and will have an elongated spring slot 38 formed on both the front side (FIG. 2A) and the rear side (FIG. 2B). Spring slot 38 will include cocking notch 39 whose function will be described below. FIG. 3A best shows how spring tube 26 will house spring rod 32 which is formed of a threaded upper rod and a lower rod 46. Spring rod 32 will be connected at its bottom to tension adjustment knob 24 such that the turning of knob 24 will also rotate spring rod 32. A spring collar 36 will be threaded onto upper spring rod 35. Spring collar 36 will be engaged by guide screw 44 (see FIG. 2C) which rides in guide slot 43. While guide screw 44 engages spring collar 36, guide screw 44 does not penetrate through spring collar 36 to engage upper rod 35. Rather, upper rod is allowed to rotate relative to spring collar 36. Guide screw 44 will serve two purposes. First, because guide screw 44 is constrained by the sides of slot 38, guide screw 44 will prevent rotation of spring collar 36 as knob 24 (and thus spring rod 32) is rotated. Therefore, the rotation of knob 24 will result in the movement of spring collar 36 up or down along the threads of upper spring rod 35. As explained below, this will serve as an indicator of the tension in spring 37. FIG. 2B shows the aperture 42 which guide screw 44 will engage. Second, guide screw 44 will act as an indicator of where spring collar 36 is located along the length of upper spring rod 35.

Referring to FIG. 2A, spring 37 will be positioned over upper spring rod 35 and will rest upon spring collar 36. Retaining ring 34 (hidden from view by spring 37) will engage a groove on the top end of upper spring rod 35 and retaining ring 34 will prevent spring collar 36 from sliding over the top of upper spring rod 35. Positioned on top of upper spring rod 35 will be end cap 33 which has a diameter just under the inside diameter of spring tube 26. Positioned on top of end cap 33 will be scallop tube 27 which is connected to scallop piece 28. Both end cap 33 and scallop tube 27 will have an aperture 45 formed there through. As suggested in FIG. 3A, eye bolt 40 will be inserted through apertures 45 and will be fixed in place by nut 41.

Figure 4:
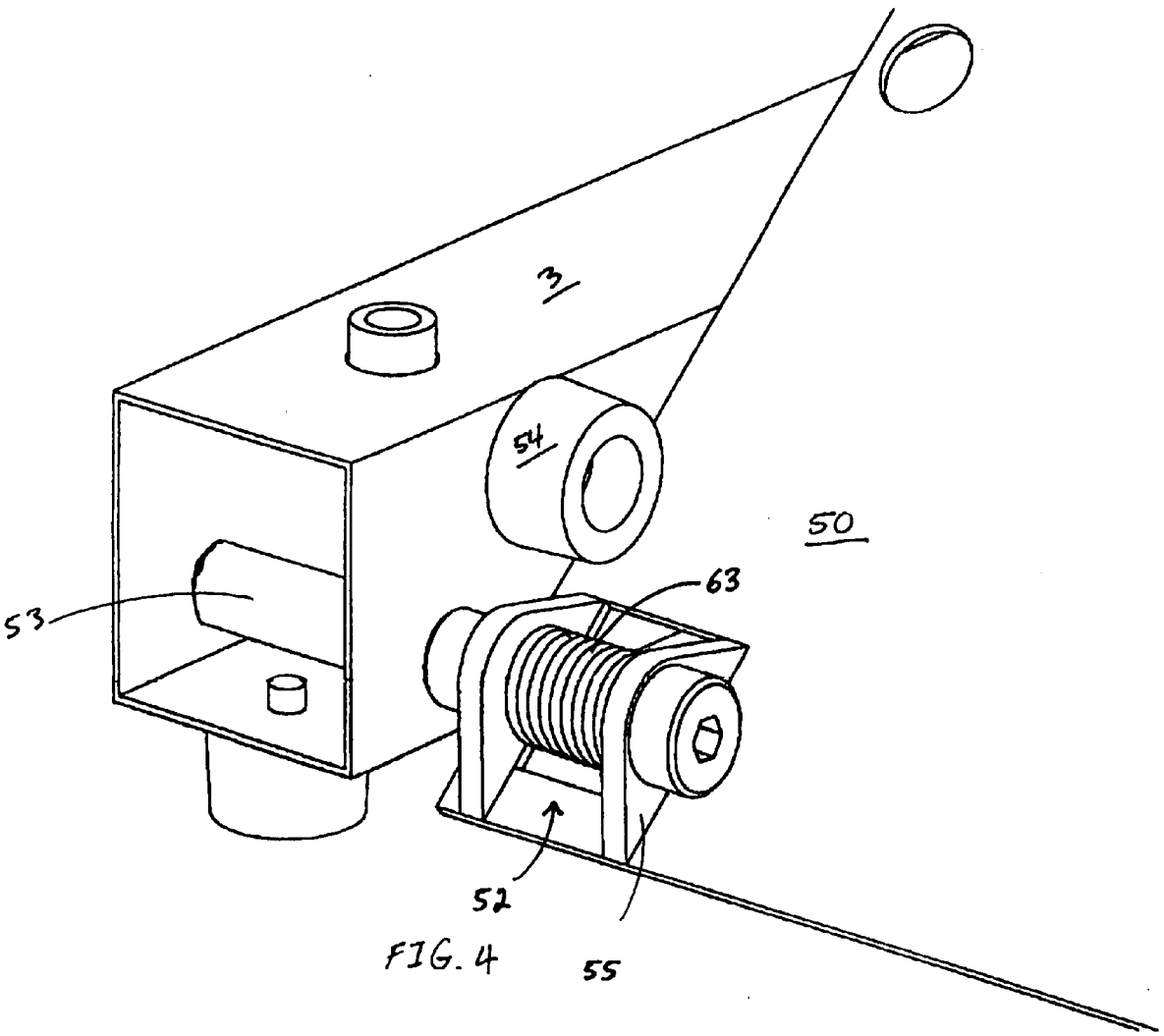
FIG. 4 is a detailed view of the hinges of the foot plate in the present invention.

Again viewing FIG. 1, another major element of training apparatus 1 is foot plate 50. Foot plate 50 is generally a flat, rectangular plate of metal, wood, plastic, or any other suitable material. Foot plate 50 will be pivotally attached to frame member 3 by way of spring hinges 52. FIG. 4 more clearly shows how spring hinges 52 are composed of hinge bracket 55, hinge spring 63 and hinge pin 53. As is well known in the art, hinge bracket 55 will be fixed to foot plate 50 and pivotally mounted on hinge pin 53. Hinge spring 63 will be connected between hinge pins 53 and hinge bracket 55. This will cause foot plate 50 to rotate upward until foot plate 50 contacts stops 54. It will be understood that foot plate 50 is biased in the upward direction by spring hinges 52. As shown in FIG. 1, foot plate 50 will also include a foot print outline 51. Foot print outline 51 will serve as a reminder of the proper foot position with the toes pointed slightly downward and the heal lifted slightly upward.

Another element of training apparatus 1 is the trigger mechanism. In the embodiment shown, the trigger mechanism generally consists of cord 56 connected to foot plate 50, extending through eyelet post 57, and connecting to eye bolt 40 on ball launcher assembly 20. It can be seen that cord 56 is connected to foot plate 50 by way of tie apertures 58, one of which is formed on each side of foot plate 50. Additionally, eyelet post 57 will be connected to frame member 3 by being inserted into post slot 48, one of which is also formed on each side of frame member 3. The operation of the trigger mechanism will be explained below.

The ball launching assembly 20 will be assembled by aligning the elements as seen in FIG. 2B and then pressing down on scallop piece 28 until end cap 33 is within spring tube 26 and scallop tube 27 has slid over spring tube 26 as suggested by FIG. 3A. When apertures 45 in scallop tube 27 and end cap 33 are at the level of spring slot 38, eye bolt 40 may be inserted through spring slot 38 and apertures 45 and nut 41 threaded onto the end of eye bolt 40 which extends through to the other side of spring tube 26. It will be understood that at this point launching assembly 20 is complete and moving eye bolt 40 downward will compress spring 37. To place ball launching assembly 20 in the firing position, it is only necessary to move eye bolt to the level of cocking notch 39 and rotate eye bolt 40 into notch 39. Thus, when eye bolt 40 is forced out of notch 39, spring 37 will accelerate scallop piece 28 upward, launching any ball which is resting on scallop piece 28. Viewing FIG. 3A, it will be clear how turning knob 24 one direction will cause spring collar 36 to move upward, compressing spring 37. This will cause spring 37 to launch a ball with greater force than when spring collar 36 is positioned further down upper spring rod 35. Similarly, turning knob 24 the other direction will move spring collar 36 downward, decrease compression of spring 37, and reduce the force accelerating the ball upward. In this manner, the height to which a ball on scallop piece 28 will be launched is fully adjustable. It will also be understood that springs with different spring constants could be used for baseballs, softballs, and plastic "wiffle" balls. In such a case, the raising or lowering of spring collar 36 will act as a "fine" adjustment of the height to which the ball is launched.

The use and operation of the present invention may be understood by first viewing FIG. 1. The training apparatus as shown in FIG. 1 is configured for a right-handed batter. The batter will stand in a batting position in front of training apparatus 1 with the lead foot against foot plate 50. The batter or a coach will then adjust forward motion restraint 10 such that it will press against the batter anywhere between the shin and hip of the lead leg. Exactly where the pad 12 will be adjusted to contact the batter (e.g., shin, thigh or hip), is a matter of preference for the batter or coach. However, it is believed preferable to have the pad 12 resting against the batter's hip. It will be readily apparent how the necessary adjustments of forward motion restraint 10 may be made by pulling inner bar 17 out of outer bar 16 and fixing the relative position of those bars with a spring pin (which is hidden from view in FIG. 1, but is identical to spring pin 23 on ball launching assembly 20). Also, the angle of forward motion restraint 10 may be easily adjusted by moving channel guide 11 at the desired position on channel 14 and securing channel guide 11 in place by tightening knob 15. The forward motion restraint 10 should be adjusted such that when the batter places the lead foot on foot decal 51, substantially all the batter's weight is on the rear foot and pad 12 is against the batter's hip, preventing him or her from being able to inadvertently transfer weight to the front foot during the swing. To launch the ball, the batter will place a slight downward pressure on foot plate 50 with the lead foot. This will cause foot plate 50 to place tension on cord 56 which will then pull on eye bolt 40 and move it out of cocking notch 39, thereby launching the ball as described above. The batter will then swing at the ball while being forced to maintain a proper stance since forward motion restraint 10 prevents the, batter from stepping forward. This forces the batter to hit against a stiff front leg and not on top of it.

While the configuration of training apparatus 1 seen in FIG. 1 is for a right-handed batter, training apparatus 1 is easily modified to accommodate a left-handed batter. This modification begins with both brackets 13 and 29 being disconnected from frame member 3. Bracket 13 may then be placed in the position where bracket 29 appears in FIG. 1. Additionally, inner bar subsection 17*a* will be withdrawn from outer bar 16, rotated such that inner bar subsection 17*b* points inward, and then be reinserted into outer bar 16. In a similar manner, bracket 29 may be positioned where bracket 13 is shown positioned in FIG. 1. It then is only necessary to rotate outer bar 21 to the other end of guide channel 14 and launching assembly 20 will be in the proper position for a left-handed batter. Cord 56 will be untied from the aperture 58 shown on the right side of foot plate 50 and retied in the aperture 58 on the left side of foot plate 50. Also, eyelet post 57 will be moved to the slot 48 on the left side of frame member 3. At this point, training apparatus 1 has been reconfigured for a left-handed batter.

Training apparatus 1 may also be easily transformed to a compact configuration for transportation. Outer bar 21 may be rotated against frame member section 3*a* and knob 31 tightened in that position. Then inner bar 22 is withdrawn from outer bar 21, rotated 90 degrees, and reinserted into outer bar 21 such that spring tube extends across the front of foot plate 50. Outer bar 16 will then be rotated downward until it contacts frame member section 3*b* and knob is tightened in that position. Finally, foot plate 50 may be pushed downward until it is below the level of aperture 5*a*. The straight end of eye post 57 is then inserted into aperture 5*a* and the eye of eye post 57 will hold foot plate 50 in the same plane as frame member 3. This configuration creates a very flat and convenient package for carrying or transportation.

Figure 5:
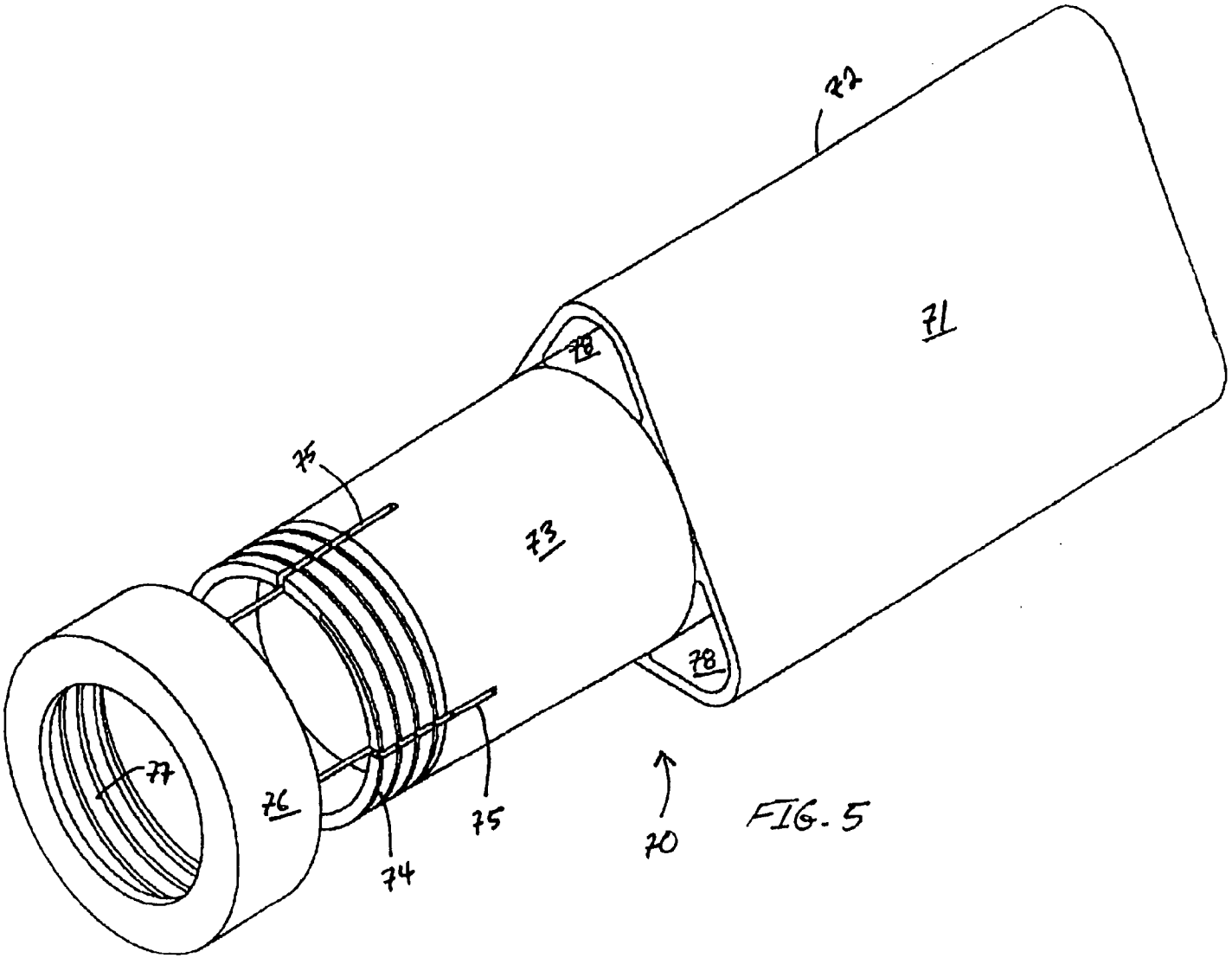
FIG. 5 is a perspective view of an alternate embodiment of the present invention.
Figure 6:
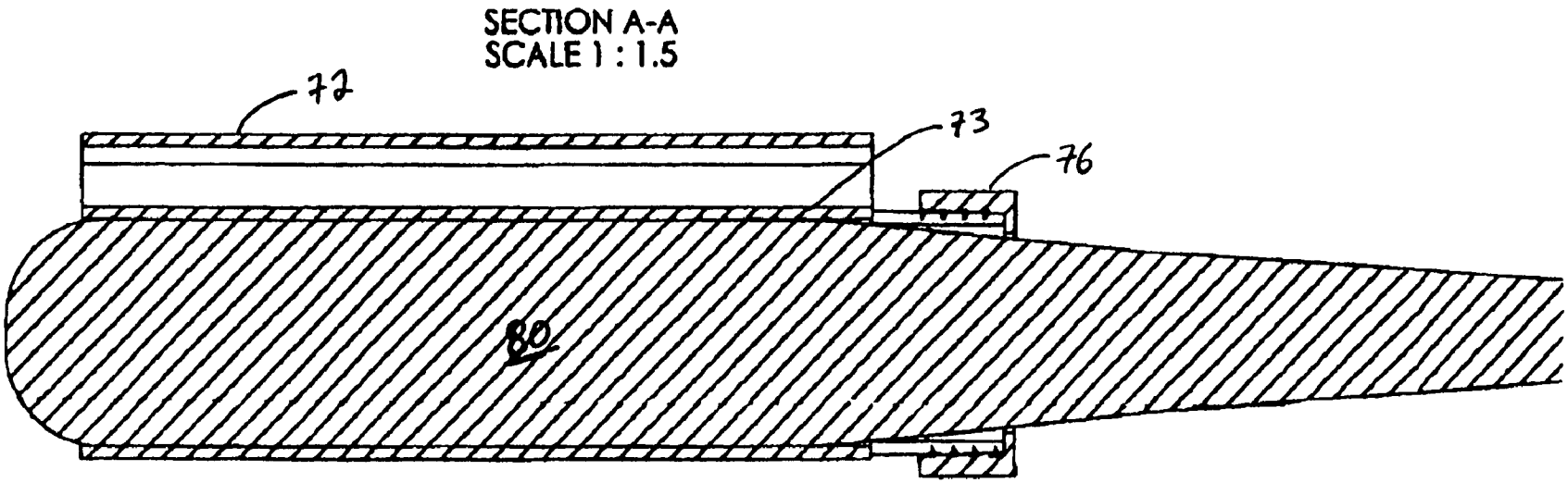
FIG. 6 is a section view showing the embodiment of FIG. 5 positioned upon a bat.

An alternate embodiment of the present invention is seen in FIGS. 5 and 6. Bat attachment 70 will be formed of a support tube 73 having a triangle or prism structure formed thereon. FIG. 6 illustrates how support tube 73 will be of a diameter approximate to bat 80. Formed on support tube 73 is a triangle having three flat sides 71 and three peaks 72. The embodiment seen in the Figures shows portions 78 of the triangle as being hollow to reduce the weight of bat attachment 70 and to reduce the amount of materials needed to produce the bat attachment 70. FIG. 5 also shows how support tube 73 may extend beyond flat sides 71. The end of this extended portion of support tube 73 will include male threaded section 74. The diameter of support tube 73 may be slightly tapered along threaded section 74, and such the diameter of support tube 73 is the smallest at the end of threaded section 74. Formed through threaded section 74 will be a series of split channels 75. Additionally, bat attachment 70 will include a tightening collar 76 which has female threaded section 77 formed therein. It will be apparent from viewing FIGS. 5 and 6 that when support tube 73 slides over the knob end of the bat 80 and is moved up the striking portion of bat 80, the spit channels 75 make it possible for threaded section 74 to spread apart slightly. When tightening collar 76 is threaded onto threaded section 74, tightening collar 76 will constrict threaded section 74 and cause it to firmly grip bat 80, thereby securely retaining bat attachment 70 to bat 80.

In operation, bat attachment 70 will be used to teach the batter not to twist or pronate his or her hands prior to striking the ball. The batter will grip the bat such that a flat surface 71 is perpendicular to the path an oncoming ball would take. If the batter twists his or her hands downward, the surface 71 will not be level and will direct the ball sharply downward upon striking the ball. If the batter twists his or her hands upward, the surface 71 will again not be level and will direct the ball sharply upward upon striking the ball. Thus, bat attachment 70 greatly exaggerates the misdirection of the ball caused by twisting the hands and bat prior to contacting the ball. Therefore, it will be immediately apparent to the batter after striking the ball whether he or she kept the hands level (in the "hammer" position) or rotated the hands up or down. This will aid the batter to recognize and correct any tendency to twist the hands during the swing.

Figure 7:
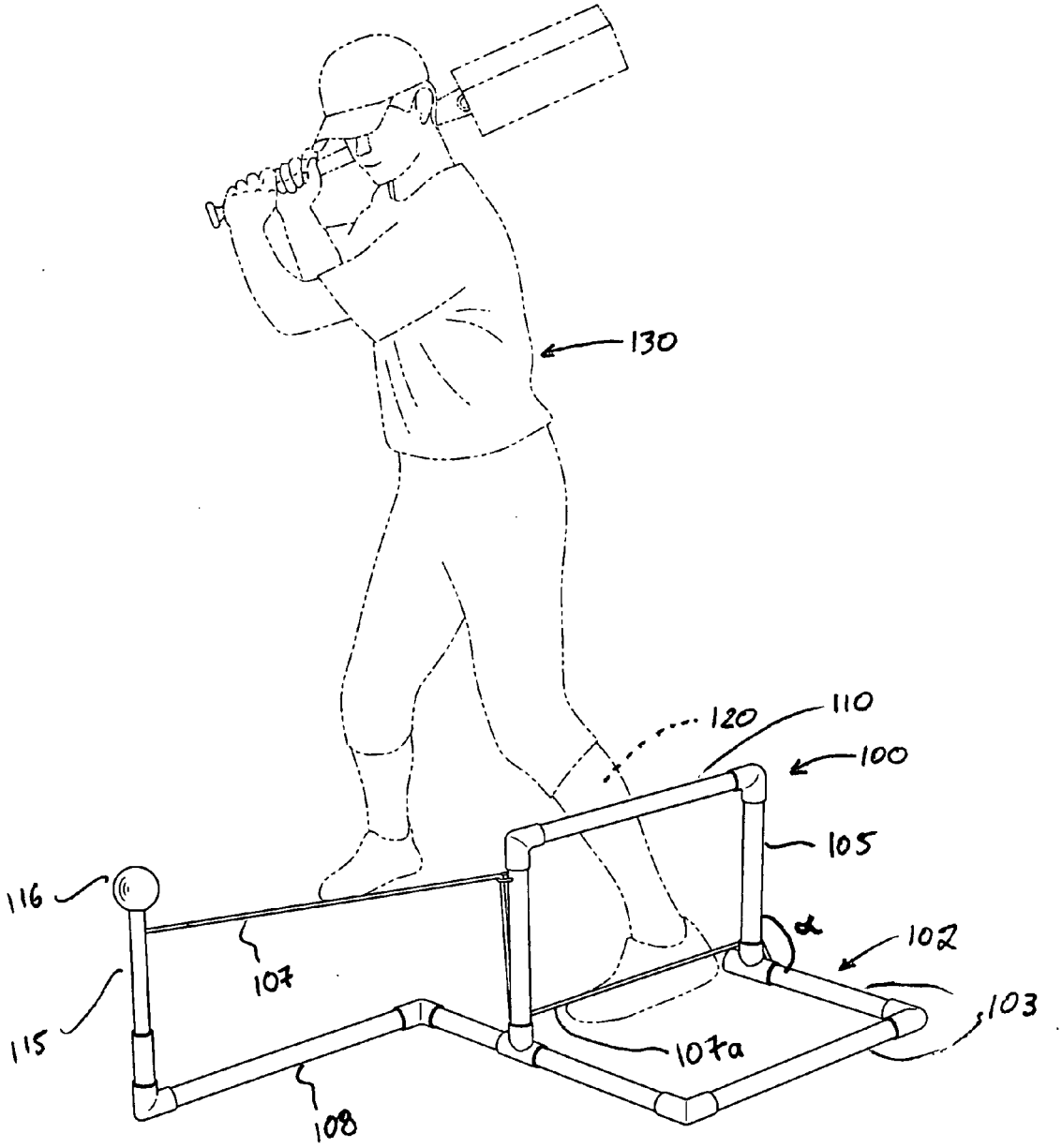
FIG. 7 is a perspective view of an alternate embodiment of the present invention.

An alternative embodiment of the present invention is seen in FIG. 7 as it will be used by the batter 130. The training apparatus 100 will include a ground frame 102 constructed of tubular sections 103 forming a U-shape frame similar to the embodiment of FIG. 1. Tubular sections 103 may be any type of material, but in one preferred embodiment are sections of PVC pipe joined to together by conventional PVC pipe fittings. Extending upward from ground frame 102 are vertical members 105. In FIG. 7, vertical members 105 extend straight upward forming a 90° angle "alpha" with ground frame 102. However, it is not critical that vertical member 105 extend straight upward and it is within the scope of the invention for vertical members 105 to extend upward at some angle (i.e. alpha being greater than 90°) such as bar 16 seen in FIG. 1. Attached between vertical members 105 is a horizontal member 110, which preferably is made of the same PVC tubing as ground frame 102 and vertical members 105. Additionally, in a preferred embodiment, vertical members 105 will be of such a length (depending on the angle alpha) that horizontal member 110 will be less than approximately 2.5 feet from the ground. This allows horizontal member 110 to contact batter 130 somewhere along the batter's shin 120. Typically, horizontal member 110 will be at least approximately 1 foot in length and more preferably approximately 1.6 feet in length.

A ball launcher 115 with a ball 116 is attached to ground frame 102 by section 108. A short section 108*a* positions ball launcher 115 behind the front foot of the batter since that foot is against cord section 107*a*. Ball launcher 115 may be any conventional device or may be a launcher such as seen in FIGS. 2A–2C. Ball launcher 115 will be triggered by cord 107 which extends from ball launcher 115 to the bottom part of ground frame 102. As with previous embodiments, cord 107 may be attached to the training apparatus by eye bolts, eye screws or other hardware which allows cord 107 to be tied to ball launcher 115, but slide along its connection points to the training apparatus between launcher 115 and cord 107's other terminal end. Section 107*a* of cord 107 will extend across the open end of U-shaped ground frame 102 and will act as part of the trigger mechanism. The batter 130 will step on cord section 107*a* in order to have it activate ball launcher 115 in a manner similar to the foot plate described in earlier embodiments.

It will be readily apparent that horizontal member 110 (and bar 16 in FIG. 1) form a forward motion restraint. This forward motion restraint prevents the batter's body from moving past the imaginary plane which is perpendicular to the ground and in which horizontal member 110 lies. Unlike other prior art training devices which prevent a batter from flexing the knees to move the body's center of gravity closer to the ground, the present invention allows the batter free movement in the vertical direction. This freedom of movement in the vertical direction is an important factor in allowing the batter to maximize the power of the swing. This freedom of vertical movement is also critical to allowing the batter to lower his body such that the swing is in the plane of the pitched ball.

Although certain preferred embodiments have been described above, it will be appreciated by those skilled in the art to which the present invention pertains that modifications, changes, and improvements may be made without departing from the spirit of the invention defined by the claims. For example, it will be apparent that the embodiment of FIGS. 1–4 and that of FIGS. 5–6 will tend to complement one another in use. The first embodiment limits forward motion while the triangular bat attachment reinforces a square wrist. Thus, the hips turn the hands through the ball and the hips must bring the bat around as opposed to rolling the wrist to do so. Both embodiments work together to optimize the batter's swing. Moreover, it will be understood that the training apparatuses seen herein could be used with stationary ball supports positioners (which simply support the ball at a predetermined height) as opposed to actual ball launchers. However, the term "ball support" should be read to include stationary ball supports and ball launchers. It will also be seen how section 108*a* extends inward parallel to one leg of U-shaped ground frame 102 and section 108 extends outwardly parallel to the top portion of U-shaped ground frame 102. All such modifications, changes, and improvements are intended to come within the scope of the present invention.

We claim:

1. A batter training apparatus comprising:

a. a ground frame section;

b. a forward motion restraint attached to said ground frame section, said forward motion restraint comprising at least two substantially vertical members extending from said ground frame section and a substantially horizontal member extending between said vertical members;

c. a ball launcher; and d. a trigger for activating said ball launcher, wherein said trigger comprises a cord extending between said vertical members.

2. The batter training apparatus according to claim 1, wherein said vertical member and said horizontal member are attached at substantially right angles to one another.

3. The batter training apparatus according to claim 1 wherein said vertical members are less than approximately 2.5 feet in height.

4. A batter training apparatus comprising:

a. a ground frame section;

b. a forward motion restraint attached to said ground frame section, said forward motion restraint comprising a substantially vertical member extending from said ground frame section and a substantially horizontal member extending form said vertical member;

c. a ball launcher;

d. a trigger for activating said ball launcher, e. a foot plate attached to said ground frame section; and f. wherein said trigger includes a cord attached to said foot plate and extending to a release pin on said ball launcher.

5. The batter training apparatus according to claim 4, wherein said foot plate is pivotally mounted on said ground frame section.

6. The batter training apparatus according to claim 1, wherein said ball launcher is connected to said ground frame section.

7. The batter training apparatus according to claim 4, wherein said trigger is operatively connected to a foot plate.

8. The batter training apparatus according to claim 4, wherein said vertical member is pivotally mounted on said ground frame section and said horizontal member forms a substantially perpendicular angle with said vertical member.

9. A batter training apparatus comprising:

a. a ground frame section;

b. a forward motion restraint attached to said ground frame section, said forward motion restraint comprising a substantially vertical member extending from said ground frame section and a substantially horizontal member extending from said vertical member;

c. a ball launcher;

d. a trigger for activating said ball launcher, e. wherein said vertical member is pivotally mounted on said ground frame section and said horizontal member forms a substantially perpendicular angle with said vertical member; and f. wherein said forward motion restraint is radially adjustable relative to said ground frame section.

10. The batter training apparatus according to claim 7, wherein the position of said ball launcher relative to said ground frame section is adjustable.

11. The batter training apparatus according to claim 6, wherein said ground frame section is configured such that said forward motion restraint and said ball launcher are reversible to accommodate either a left-handed or a right-handed batter.

12. The batter training apparatus according to claim 1, wherein said ground frame section is generally U-shaped.

13. The batter training apparatus according to claim 1, further including an attachment for a baseball bat comprising:

a. a support tube having a diameter approximate to that of a bat at said bat's striking surface; and b. three substantially flat striking surfaces connected to and surrounding said support tube, thereby forming a triangular structure around said support tube.

14. The batter training apparatus according to claim 1, wherein said forward motion restraint is adjustable such that it will press against a user's lead leg between said user's shin and hip.

15. A batter training apparatus comprising:

a. a ground frame section;

b. a forward motion restraint attached to said ground frame section, said forward motion restraint being adjustable such that said forward motion restraint is positionable at various levels with respect to a body of a user positioned to use said training apparatus;

c. a ball launcher;

e. a foot plate attached to said ground frame section; and d. a trigger for activating said ball launcher, wherein said trigger includes a cord attached to said foot plate and extending to a release pin on said ball launcher.

16. The batter training apparatus according to claim 15, wherein said ball launcher includes a spring slot in which said release pin travels and a cocking notch at a bottom portion of said release.

* * * * *